United States Patent [19]

Ritter

[11] Patent Number: 5,056,710

[45] Date of Patent: Oct. 15, 1991

[54] BOX WITH SELF-LOCKING HINGED COVER SECTIONS

[75] Inventor: Karl M. Ritter, Carol Stream, Ill.

[73] Assignee: Container Corporation of America, Clayton, Mo.

[21] Appl. No.: 690,170

[22] Filed: Apr. 19, 1991

[51] Int. Cl.[5] ..... B65D 5/20

[52] U.S. Cl. ..... 229/143; 229/144; 229/148

[58] Field of Search ..... 229/143, 144, 148, 149

[56] References Cited

U.S. PATENT DOCUMENTS

| | | | |
|---|---|---|---|
| 1,003,150 | 9/1911 | Potter | 229/143 |
| 1,230,675 | 6/1917 | Cole | 229/143 |
| 1,738,744 | 12/1929 | Walter | 229/144 |
| 2,189,920 | 2/1940 | Mulnix | 229/144 |
| 2,842,303 | 7/1958 | Platt | 229/144 |
| 2,914,234 | 11/1959 | Hazelwood | 229/144 |
| 3,019,958 | 2/1962 | Asman et al. | 229/144 |
| 3,193,175 | 7/1965 | Moreton | 229/144 |
| 3,415,358 | 12/1968 | Faller | 229/143 |

FOREIGN PATENT DOCUMENTS

| | | | |
|---|---|---|---|
| 274645 | 7/1951 | Switzerland | 229/143 |
| 1035573 | 7/1966 | United Kingdom | 229/143 |

*Primary Examiner*—Gary E. Elkins
*Attorney, Agent, or Firm*—Richard W. Carpenter

[57] ABSTRACT

A collapsible box that can be formed from a one-piece sheet of foldable paperboard and that has opposed side and end walls and a top wall or cover that includes a pair of sections hinged to the end walls and that can be kept closed by snug, interlocking, frictional engagement between inner and outer panels of the side walls.

12 Claims, 2 Drawing Sheets

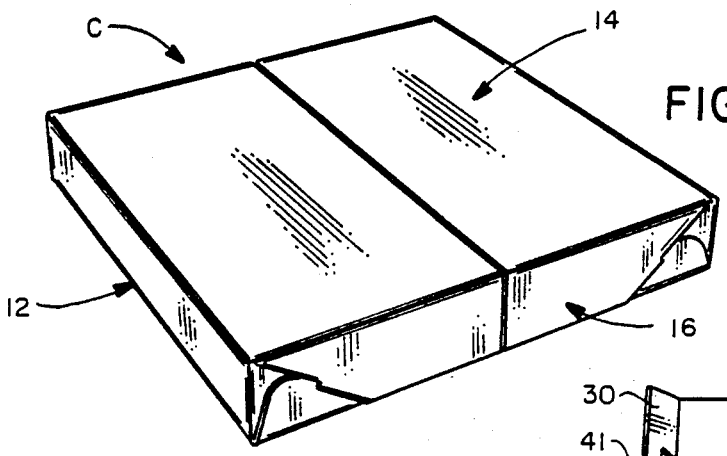
FIG. 1
FIG. 3
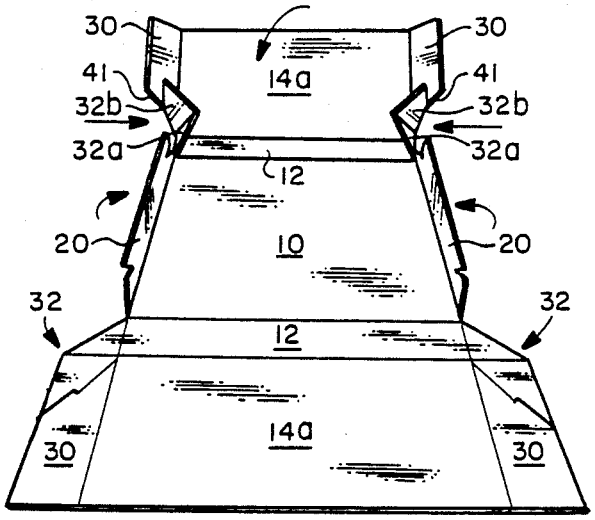
FIG. 4
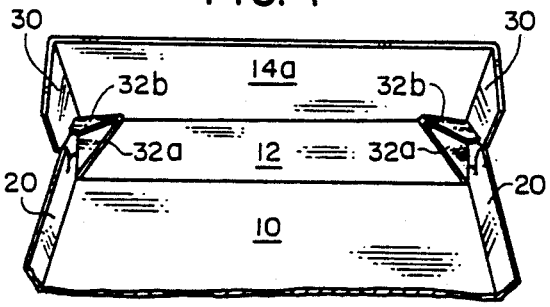
FIG. 5
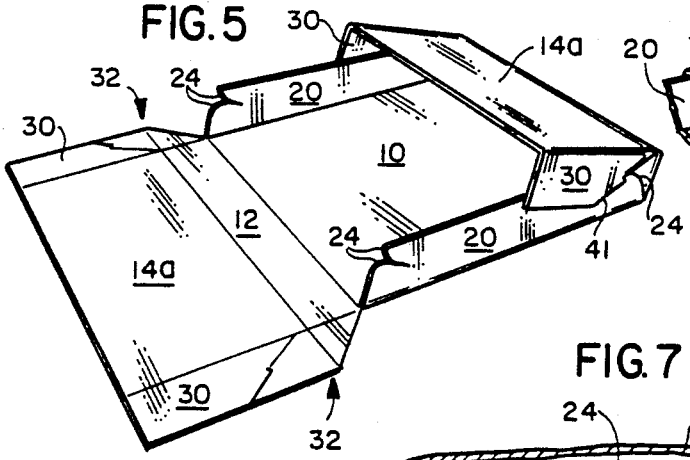
FIG. 6
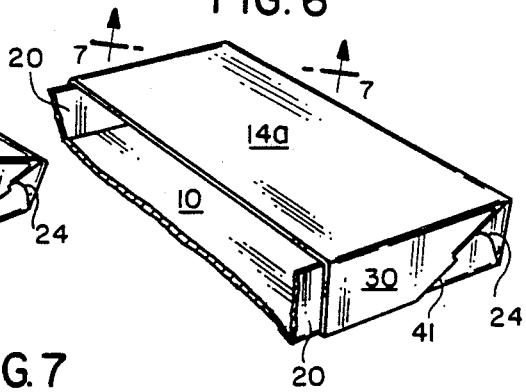
FIG. 7
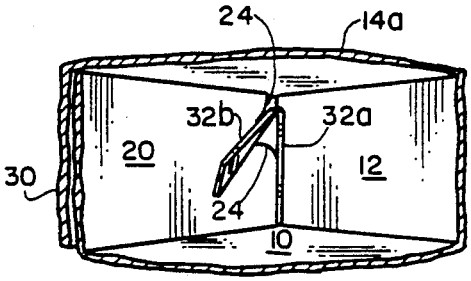

BOX WITH SELF-LOCKING HINGED COVER SECTIONS

BACKGROUND OF THE INVENTION

1. Field of the Invention:

This invention relates to paperboard containers and more particularly to one-piece paperboard boxes of the type commonly used for the packaging of pizza and similar products. These boxes have hinged cover sections that may be easily opened and reclosed. The invention provides a way to help keep the cover sections closed.

2. Description of Background Art:

A background art search directed to the subject matter of this application and conducted in the United States Patent and Trademark Office disclosed the following U.S. Pat. Nos.: 1,600,260, 1,530,643, 2,793,801, 2,550,582, 2,041,021, 3,368,734, 3,581,976.

None of the patents uncovered in the search discloses a box with a pair of self locking cover sections that are joined to the end walls of the carton by the unique web members of the present invention which provide a snug, interlocking, friction type fit between the inner and outer panels of the side walls that is adapted to prevent the cover sections from opening accidentally.

SUMMARY OF THE INVENTION

It is a primary object of the present invention to provide a one-piece paperboard box having a pair of hinged cover sections that may be readily opened, but which will remain closed until they are opened intentionally.

A more specific object of the invention is the provision of a box of the type described wherein a pair of co-planer cover sections are hingedly attached to opposed end walls of the box by novel web means that provide an especially snug, interlocking, friction type fit between the outer and inner panels of the side walls to maintain the cover sections closed.

These and other objects of the invention will be apparent from an examination of the following description and drawings.

BRIEF DESCRIPTION OF THE DRAWINGS

FIG. 1 is a fragmentary isometric view of a box embodying features of the present invention, shown in the closed position;

FIGS. 3–6 are fragmentary isometric views, with sections of the structure broken away to illustrate the manner in which the box illustrated in FIG. 1 is erected from the blank illustrated in FIG. 2; and FIG. 7 is a fragmentary isometric view of an inside corner of the box illustrated in the other views.

Figure 2:
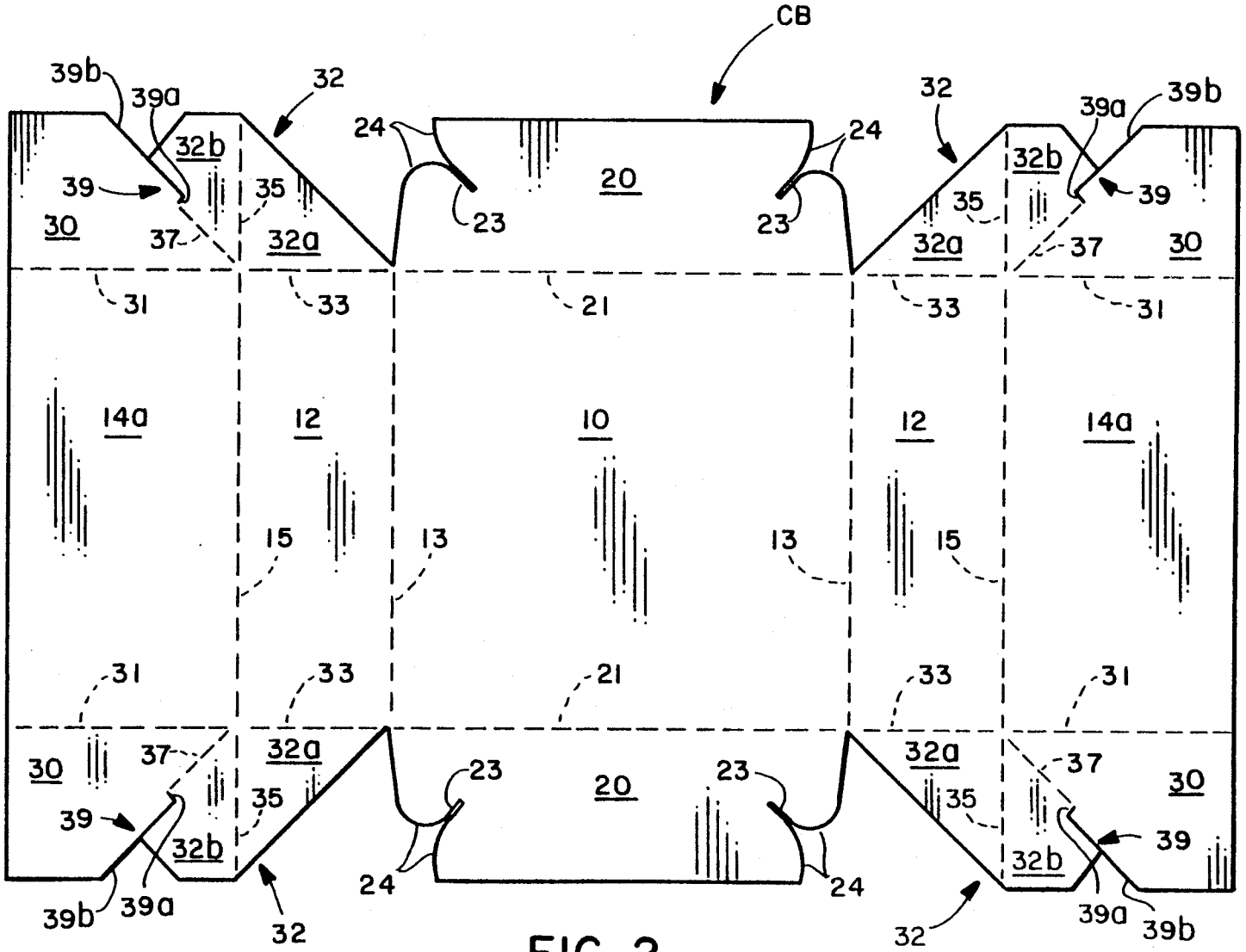
FIG. 2 is a plan view of a blank of foldable sheet material from which the box illustrated in the other views may be formed.

It will be understood that, for purposes of clarity, certain elements may have been intentionally omitted from certain views where they are believed to be illustrated to better advantage in other views.

DESCRIPTION OF THE PREFERRED EMBODIMENT

Referring now to the drawings for a better understanding of the invention, it will be seen that the unique box or container embodying features of the invention, and indicated generally at C in FIGS. 1 and 3–7, may be formed from the unitary blank B of foldable sheet material, such as paperboard, illustrated in FIG. 2.

Box C includes a generally rectangular bottom wall 10, a top wall 14, a pair of opposed end walls 12, and a pair of opposed side walls 16.

As best seen in FIGS. 2 and 3, the blank B, from which the box C illustrated in the other views may be formed, includes a top wall first panel or cover section **14*a*, a first side wall panel 12, a bottom wall panel 10, a second side wall panel 12, and a second cover or top wall panel 14*a*, which are foldably joined to each other along parallel fold lines 15, 13, 13, and 15**, respectively.

The top wall or cover includes a pair of co-planer top wall panels or cover sections **14*a* which have outboard edges foldably joined, along fold lines 15, to upper edges of respective end wall panels 12**, and which have inboard edges disposed in abutting relationship preferably at the center of the box.

As best seen in FIGS. 5 and 6, the top, bottom, and end walls are each single-ply; whereas, the side walls are each formed from a plurality of inner and outer panels joined to opposed side edges of the bottom and top wall panels, as hereinafter described.

Each side wall 16 includes an inner panel 20, foldably joined along fold line 21 to a side edge of bottom wall panel 10 and extending upwardly therefrom, and a pair of outer panels 30, foldably joined along fold lines 31 to related side edges of top wall panels **14*a*** and extending downwardly therefrom.

It will be seen that each of the side wall inner panels have, at the upper corners thereof, elongated, diagonally inwardly extending slots 23. Also, at the corners of each side wall inner panel 20, adjacent the openings of slots 23, there are provided rounded corner edges of the panels, indicated generally at 24, which facilitate entry of other portions of the web members 32 into the slots as hereinafter described.

An essential feature of the invention is the provision of a novel web arrangement whereby each of the side wall outer panels 30 is foldably connected to an adjacent end wall 12 by means of a web or gusset member indicated generally at 32.

Each of the web members 32 includes a generally triangular first panel **32*a*, foldably joined to a side edge of end wall panel 12 along a fold line 33, and a generally triangular second panel 32*b*, foldably joined to first panel 32*a* along a fold line 35, which is an extention of fold line 15 which joins end wall panel 12 to a top wall panel 14*a***.

Web member second panel **32*b* is also foldably joined to the adjacent or related side wall outer panel 30 along a fold line 37 which extends diagonally outboardly from the inner corner of side wall outer panel 30** approximately half of the distance to the outer extremity of the side wall outer panel.

From this point, gusset member second panel **32*b* is seperated from the adjacent side wall outer panel 30 by a generally L-shaped cut line 39, which has a short leg 39*a* extending normal to fold line 37 and a long leg 39*b*** extending diagonally outboardly from an end of the short leg.

As best seen in FIG. 3, when the web member panels are folded against each other and against the inside side wall inner panel 20, the L-shaped cut lines 39 form elongated openings 41 in the gusset member second panel adjacent the side wall outer panel 30. The purpose of each of these openings 41 is to provide a snug, interlocking, frictional type fit between the side wall inner and outer panels when the box is assembled in a manner hereinafter described.

In order to erect the box from the blank, side wall panels 20 are folded upwardly 90 degrees from bottom wall panel 10. At the same time, end wall panels 12 are folded upwardly 90 degrees from bottom wall panel 10, and the panels of the gusset members are folded in back-to-back relationship against the inside surface of related side wall outer panel 30. After the box has been filled, the top wall panels 14*a* are folded over in parallel relationship with bottom wall panel 10 with their inboard edges meeting at the center of the box to form a cover.

As this is done, the outer corner portions of each side wall inner panel 20 are trapped between the related gusset member second panel 32*b* and related side wall outer panel 30, with each slot 41 disposed in mutual engagement with the related slot 23 in the corner of the side wall inner panel to provide a snug, interlocking, frictional fit therebetween which prevents the cover or top wall panels from opening by accident.

Thus, it will be seen that the invention provides a one-piece box with a pair of hinged, co-planer, cover panels and novel means for maintaining the cover panels in closed position until it is desired to open the box.

What is claimed is:

1. A collapsible box with a pair of integral, self-locking, hinged, top wall cover sections, said box being formed from a unitary blank of foldable paperboard, and comprising:

(a) a generally rectangular bottom wall panel;

(b) end wall panels having lower edges foldably joined to and upstanding from opposed end edges of said bottom wall panel;

(c) a pair of co-planer top wall panels having outboard end edges foldably joined to upper edges of respective end wall panels and having inboard end edges in abutting relation;

(d) a pair of opposed side walls, each including;

(i) an inner panel having a lower edge foldably joined to and upstanding from a side edge of said bottom wall panel;

(ii) a pair of outer panels foldably joined to and depending from corresponding side edges of respective top wall panels;

(e) web members foldably joining said side wall outer panels to related end wall panels, each including first and second panels foldably joined to each other along a fold line aligned with a fold line between related end wall and top wall panels;

(f) said web member first panel being foldably joined to a side edge of a related end wall panel;

(g) said web member second panel being foldably joined on a diagonally extending fold line to a related side wall outer panel and being separated therefrom by a cut line that forms an opening between said web member second panel and said side wall outer panel adapted to receive an adjacent corner portion of said side wall inner panel to provide snug, interlocking, frictional engagement between said side wall inner and outer panels.

2. A collapsible box with a pair of integral, self-locking, hinged, top wall cover sections, said box being formed from a unitary blank of foldable paperboard, and comprising:

(a) a generally rectangular bottom wall panel;

(b) end wall panels having lower edges foldably joined to and upstanding from opposed end edges of said bottom wall panel;

(c) a pair of co-planer top wall panels having outboard end edges foldably joined to upper edges of respective end wall panels and having inboard end edges in abutting relation;

(d) a pair of opposed side walls, each including;

(i) an inner panel having a lower edge foldably joined to and upstanding from a side edge of said bottom wall panel;

(ii) a pair of outer panels foldably joined to and depending from corresponding side edges of respective top wall panels;

(e) web members foldably joining said side wall outer panels to related end wall panels, each including first and second panels foldably joined to each other along a fold line aligned with a fold line between related end wall and top wall panels;

(f) said web member first panel being foldably joined to a side edge of a related end wall panel;

(g) said web member second panel being foldably joined on a diagonally extending fold line to a related side wall outer panel and being seperated from each other by a cut line;

(h) the panels of each of said web members being disposed in face-to-face relation inwardly adjacent said end wall inner panel at opposite ends thereof and being arranged and disposed to provide snug, interlocking, frictional engagement between said side wall inner and outer panels.

3. A unitary blank of foldable paperboard for use in forming a collapsible box with a pair of integral, self-locking, hinged, top wall cover sections, said blank being cut and scored to provide:

(a) a generally rectangular bottom wall panel;

(b) end wall panels foldably joined to opposed end edges of said bottom wall panel;

(c) top wall panels foldably joined to end edges of respective end wall panels;

(d) side wall inner panels foldably joined to opposed side edges of said bottom wall panel, each having elongated openings extending diagonally inward from outer corners thereof;

(e) side wall outer panels foldably joined to opposed side edges of respective top wall panels;

(f) web members located adjacent each corner of said bottom wall panel between related side wall inner and outer panels, each web member including:

(i) a generally triangular first panel foldably joined to a side edge of a related end wall panel;

(ii) a generally triangular second panel foldably joined along one edge to a side edge of said first panel, on a first fold line aligned with a fold line joining said related end wall panel to an adjacent top wall panel, and foldably joined to said first panel, along a diagonally extending second fold line that diverges from said first fold line at an acute angle, and separated from said first panel by a cut line extending outboardly from said second fold line.

4. A box according to claim 1, wherein said cut line is generally L-shaped and includes a short leg extending generally normal to said diagonally extending fold line, at an outboard end thereof, and a long leg extending outboardly from said short leg in generally parallel relationship with said diagonally extending fold line.

5. A box according to claim 2, wherein said cut line is generally L-shaped and includes a short leg extending generally normal to said diagonally extending fold line, at an outboard end thereof, and a long leg extending outboardly from said short leg in generally parallel relationship with said diagonally extending fold line.

6. A blank according to claim 3, wherein said cut line is generally L-shaped and includes a short leg extending generally normal to said diagonally extending fold line, at an outboard end thereof, and a long leg extending outboardly from said short leg in generally parallel relationship with said diagonally extending fold line.

7. A box according to claim 5, wherein said cut line in said web member forms an opening between said web member second panel and said side wall outer panel adapted to receive an adjacent corner portion of said side wall inner panel to provide snug, interlocking, frictional engagement between said side wall inner and outer panels.

8. A box according to claim 1, wherein each of said side wall inner panels has elongated openings extending diagonally downward and inward from upper corners thereof arranged and disposed for mutual engagement with related web member openings.

9. A box according to claim 7, wherein each of said side wall inner panels has elongated openings extending diagonally downward and inward from upper corners thereof arranged and disposed for mutual engagement with related web member openings.

10. A box according to claim 8, wherein each of said side wall inner panels presents, adjacent both sides of each of said elongated openings, rounded edges arranged and disposed to facilitate engagement between said side wall inner panel and said web member.

11. A box according to claim 9, wherein each of said said side wall inner panels presents, adjacent both sides of each of said elongated openings, rounded edges arranged and disposed to facilitate engagement between said side wall inner panel and said web member.

12. A blank according to claim 3, wherein each of said side wall inner panels presents, adjacent both sides of each of said elongated openings, rounded edges arranged and disposed to facilitate engagement between said side wall inner panel and said web member.

* * * * *